United States Patent [19]

Deutsch

[11] 4,083,282

[45] Apr. 11, 1978

[54] ALTERABLE VOICE FOR ELECTRONIC MUSICAL INSTRUMENT

[75] Inventor: Ralph Deutsch, Sherman Oaks, Calif.

[73] Assignee: Deutsch Research Laboratories, Ltd., Los Angeles, Calif.

[21] Appl. No.: 715,614

[22] Filed: Aug. 18, 1976

[51] Int. Cl.[2] ..... G10F 1/00; G10H 1/02; G10H 3/06

[52] U.S. Cl. ..... 84/1.19; 84/1.03; 84/1.17; 84/1.24

[58] Field of Search ..... 84/1.01, 1.03, 1.11, 84/1.17, 1.19, 1.22, 1.23, 1.24, 1.28

[56] References Cited

U.S. PATENT DOCUMENTS

| | | | |
|---|---|---|---|
| 3,515,792 | 6/1970 | Deutsch | 84/1.28 X |
| 3,833,750 | 9/1974 | Iorio | 84/1.17 |
| 3,908,504 | 9/1975 | Deutsch | 84/1.22 |
| 3,956,960 | 5/1976 | Deutsch | 84/1.11 |

*Primary Examiner*—Edith S. Jackmon

[57] ABSTRACT

Tone generation in a musical instrument is accomplished by repetitively computing a Fourier algorithm using stored sets of harmonic coefficients. An alterable voice is obtained by optically reading a data card, converting the data to a data format used by the tone generating circuitry, and storing the converted data to be employed as a set of harmonic coefficients. Harmonic coefficient data is encoded on the data card by imprinting columns of opaque areas. The length of each column is measured by sequentially scanning a linear array of light sources. Insertion of the data card in an enclosure automatically initializes the reading circuitry and removing the card causes each opaque data column to be measured in turn and the result converted to a harmonic component.

11 Claims, 6 Drawing Figures

ALTERABLE VOICE FOR ELECTRONIC MUSICAL INSTRUMENT

BACKGROUND OF THE INVENTION

1. Field of the Invention

The present invention relates to the production of alterable tones in a musical tone synthesizer.

2. Description of the Prior Art

An electronic organ characteristically is capable of a large number of tonal variations produced by adding a set of preselected tones in all possible combinations. For example, if a given keyboard has 6 stops, or preselected tones, a total of 63 combinations is possible. In spite of this apparent large variety, musicians are constantly seeking new and distinctive tones with which to play particular music.

The Hammond organ introduced about 40 years ago provided a set of 9 drawbars for varying the tone of a keyboard. The system of drawbars has been widely used and even today new organs are designed using this method of obtaining tone variation. A limitation of the drawbar system is that only 9 harmonics are provided which do not suffice for very "bright" tones which may contain about 32 harmonics. Abortive attempts have been made to increase the number of drawbars. However, a set of 32 individual harmonic level controls is beyond the technical and mechanical ability of the average musician. It is both difficult and extremely time consuming to set 32 individual controls.

Organs have been built wherein an alterable voice is provided by reading waveshape data punched on a computer card. This system suffers from requiring computer generated data which requires technology beyond the capability of the musician.

It is an object of the present invention to implement an alterable voice in a tone synthesizer type of musical instrument employing stored sets of harmonic coefficients to generate tones.

Another object is to introduce new sets of harmonic coefficients encoded by imprinting opaque areas on a transparent data card, the encoding employed being readily interpreted as the harmonic spectra of a musical tone.

SUMMARY OF THE INVENTION

In a Polyphonic Tone Synthesizer of the type described in U.S. Pat. application No. 603,776 (filed Aug. 11, 1975), a computation cycle and a data transfer cycle are repetitively and independently implemented to provide data which is converted into musical tones. During the computation cycle a master data set is created by implementing a discrete Fourier algorithm using a stored set of harmonic coefficients which characterize musical tones.

A variable voice capability is introduced by reading data encoded on a card into a memory in a form that corresponds to these harmonic coefficients. The data encoding consists of applying opaque columns to a transparent data card. The length of each column corresponds to a harmonic coefficient expressed in db. The appearance of an encoded card is recognizable as the conventional harmonic spectrum of a musical tone drawn in the form of realtive db vs. harmonic number.

An optical card reader is employed for reading harmonic strength data encoded on the card. Inserting the card in the reader automatically initializes the reader and storage circuitry and places the system in read mode. As the card is withdrawn manually, a sequence of transparent areas causes an array of light sources to be scanned over the position of each column in turn. A photo cell detects when a light in the array is scanned in the first position not covered by an opaque column. The scan data is converted to a harmonic coefficient and stored in a read-write memory position corresponding to the current scanned opaque column.

Data cards can be easily prepared by the musician and can be readily duplicated by conventional photographic processing.

Provision is made for employing the same card reader and data card encoding to load a read-write memory with a set of control data for preselecting the value of a number of tone synthesizer controls.

DESCRIPTION OF THE PREFERRED EMBODIMENT

Figure 1C:
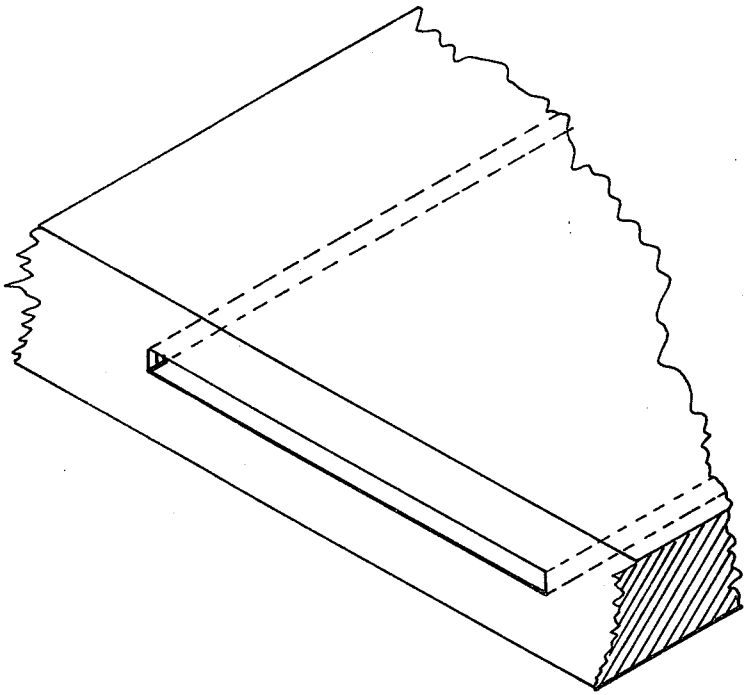
FIG. 1*c* shows the card reader enclosure.

The following description is of the best presently contemplated modes of carrying out the invention. This description is not to be taken in a limiting sense, but is merely for the purpose of illustrating the general principles of the invention since the scope of the invention is best defined by the appended claims. Structural and operational characteristics attributed to forms of the invention first described shall also be attributed to forms later described, unless such characteristics are obviously inapplicable or unless specific exception is made.

The alterable voice disclosed herein operates in conjunction with musical generators of the type wherein the tone generator incorporates means for computing wave shapes from stored tables of harmonic coefficients. The alterable voice will be described in conjunction with the Polyphonic Tone Synthesizer disclosed in U.S. Pat. application No. 603,776 (filed Aug. 11, 1975). It can be used in an analogous fashion with a musical tone generator of the type described as a Computor Organ in U.S. Pat. No. 3,809,786.

In the Polyphonic Tone Synthesizer a computation cycle and data transfer cycle are repetitively and independently implemented to provide data which is converted into musical notes. During the computation cycle a master data set is created by implementing a discrete generalized Fourier algorithm using a stored set of harmonic coefficients which characterize the basic musical tone. Preferably, the harmonic coefficients and the orthogonal functions are stored in digital form, and the computations are carried out digitally. At the end of the computation cycle, a master data set has been created and is temporarily stored in a data register.

Following a computation cycle, a transfer cycle is initiated which transfers the master data set to a multiplicity of read-write memories. The transfer for each memory is initiated by detection of a synchronizing bit and is timed by a clock which may be asynchronous with the main system clock and has a frequency Pf, where $f$ is the frequency of a particular note assigned to a memory and P is at least two times the maximum number of harmonics in the musical waveshape. The transfer cycle is completed when all the memories have been loaded, at which time a new computation cycle is initiated. Tone generation continues uninterrupted during computation and transfer cycles.

The master data set is computed according to the relation $$Z_N = \sum_{q=1}^{W} c_q \sin(2\pi \frac{Nq}{2W}) \qquad \text{(Equation 1)}$$

where N=1,2, . . . , 2W is the number of a master data set word, $q$=1,2, . . . , W is the harmonic number, W is the number of harmonics used to compute the master data set, and $c_q$ are the harmonic coefficients. $q$ is sometines called the order of the harmonic component of an element in the series constituting $Z_N$. The number of harmonics, W, is a design choice. The choice of W=32 is satisfactory for generating the "bright" tonal sounds of a musical tone synthesizer.

Figure 2:
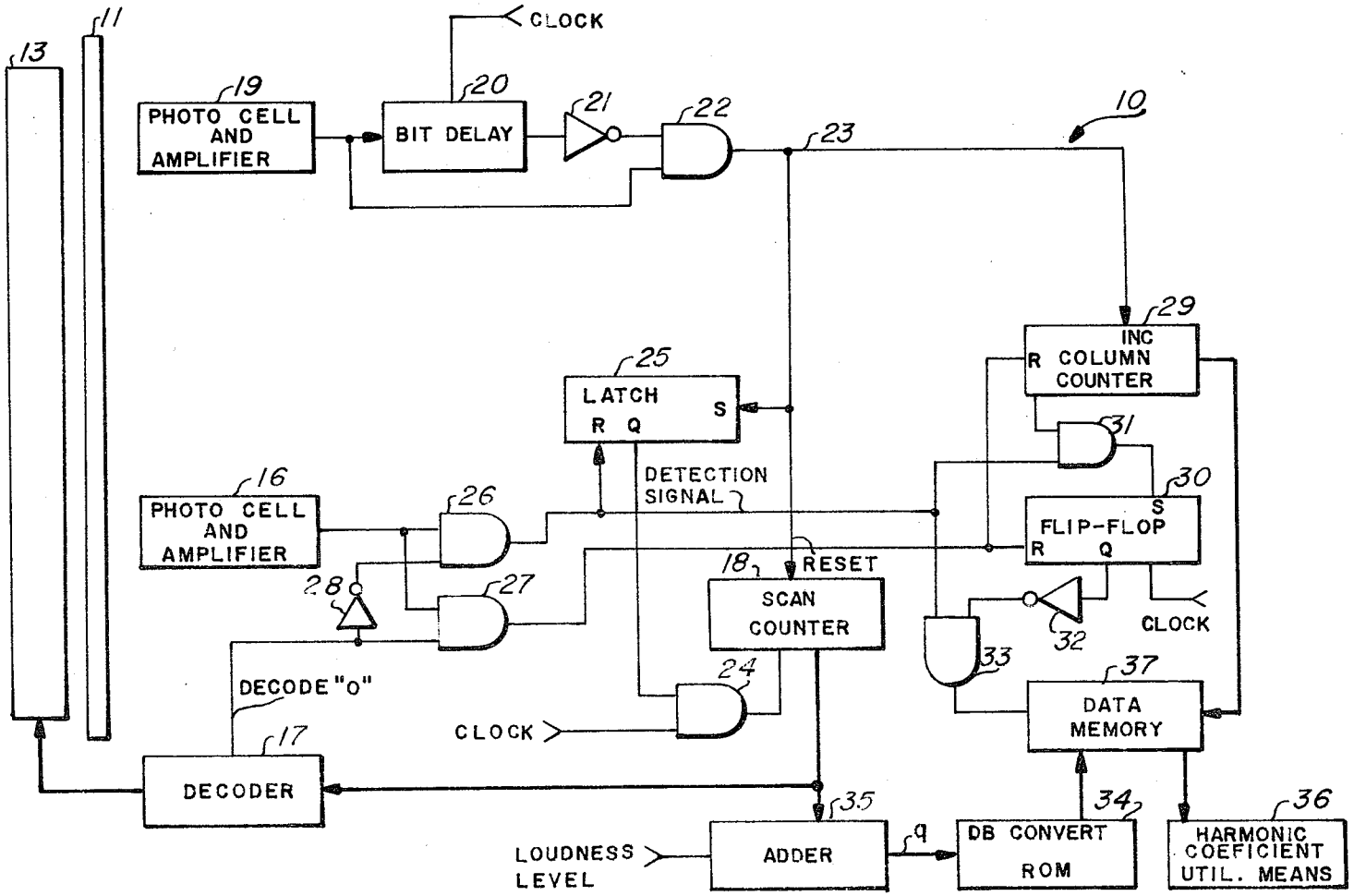
FIG. 2 shows the card reader circuitry.

System 10 of FIG. 2 illustrates the alterable voice used in conjunction with a musical tone generator such as the above referenced Polyphonic Tone Synthesizer. System 10 is a means whereby harmonic data printed on Card 11 is read and converted to harmonic coefficients $c_q$ which are stored in a Data Memory 37.

Figure 1A:
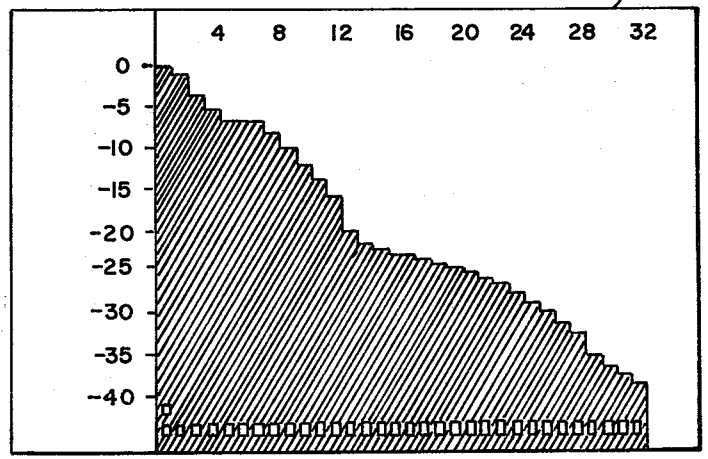
FIG. 1*a* illustrates an encoded card.

Card 11 shown in FIG. 1*a* is advantageously constructed of a clear material that passes light with little loss. Information is encoded on Card 11 by causing specified areas to be opaque to light. The opaque areas can be applied by ink, pencil, or can readily be produced by conventional photographic processes from prepared art work. The data to be read and interpreted by System 10 of FIG. 2 is coded in 32 columns, each column corresponding to a harmonic coefficient $c_q$.

The required accuracy of the art work in drawing the opaque areas on Card 11 is reduced by coding the harmonic coefficients $c_q$ in db (decibels) relative to the strongest harmonic component. System 10 contains a means for transforming data coded on Card 11 in db to the number system used in the Polyphonic Tone Synthesizer for specifying the magnitude of the harmonic coefficients used in Equation 1. The height of each column thus corresponds to the desired harmonic coefficient expressed in relative db.

Figure 1B:
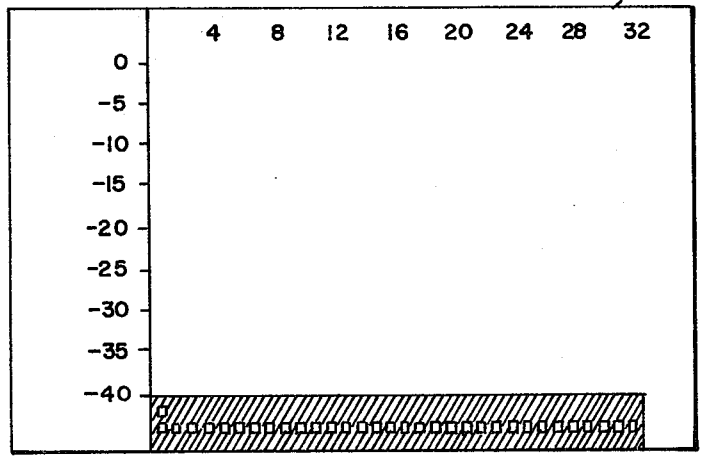
FIG. 1*b* illustrates a blank card.

At the bottom edge of Card 11 is an opaque strip which has a sequence of 32 clear areas. These clear areas are aligned with the columns that correspond to each of the harmonic coefficients $c_q$. In the first column of the sequence of 32 columns is an opaque strip having two clear areas as shown in FIG. 1*b*. The lower clear area is at the same position as the sequence of 32 clear areas. The upper area, called the initializer area, is at a higher position but lower than the opaque strip running along the lower edge of the card representing the minimum value of the encoded data. The two clear areas are used by System 10 to detect that Card 11 has been fully inserted into the card reader and to initialize the detection and reading circuitry. The sequence of 32 clear areas are used to initiate data read for each of the harmonic coefficients coded by the opaque areas of the card.

FIG. 1*b* shows a card containing opaque areas for detection and reading. The card is clear except for guide lines. The musician can code his own musical tone by opaquing the card with a suitable pen or pencil depending upon the material used to construct the card. The cross-hatched areas symbolically denote opaque areas.

FIG. 1*c* shows a slot for inserting Card 11 in a card reader conveniently mounted on a musical instrument. Card 11 is fully inserted until a stop is encountered. The card is then withdrawn at any desired speed. When the stop is reached upon insertion, System 11 detects this condition and automatically enters a read mode. The read mode is operative while the card is withdrawn from Card Reader 12 shown in FIG. 3.

Figure 3A:
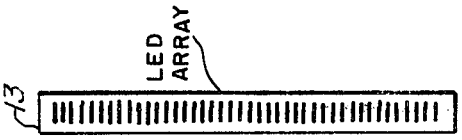
FIG. 3*a* shows the linear array of light sources.
Figure 3:
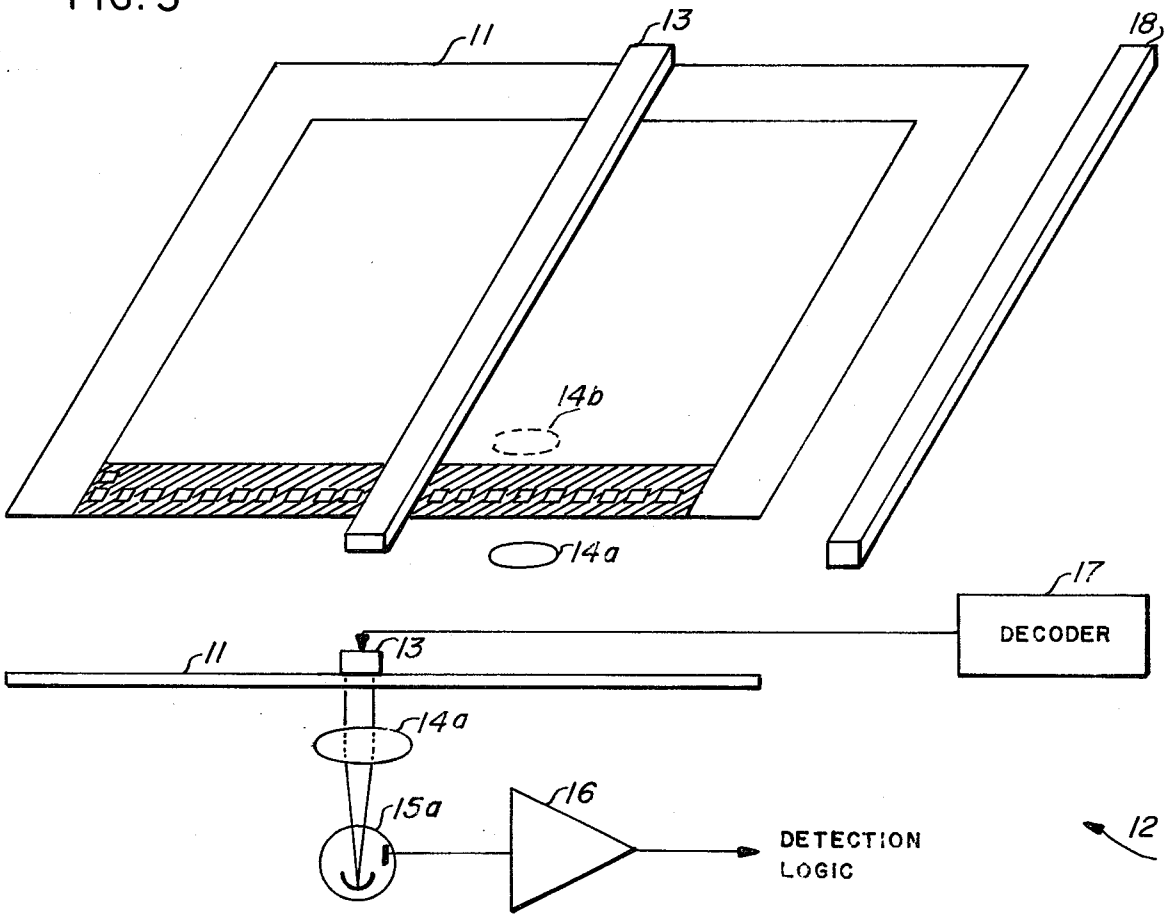
FIG. 3 shows the optical card reader.

FIG. 3 shows the elements of the Card Reader 12. Stop 18 is positioned such that when Card 11 is inserted against the stop, the detect clear hole is immediately below the clock light source in the Array 13 of light sources. Advantageously the Array 13 of light sources is an array of LED (light emitting diodes). While any number of light sources can be used in the array, the system operation will be described for an array of 42 lights. This number corresponds to a capability of reading harmonic coefficient $c_q$ to a resolution of 0 to 39 db which is adequate for the operation of the polyphonic tone synthesizer. The two extra lights are used to initiate the card reading process and to transfer the data read to a specific address in a memory used to store data read from Card 13.

To read the data from Card 13, the card is inserted in the slot shown in FIG. 1*c* until the inserted edge of the card encounters the Stop 18. The card is then withdrawn from the slot. The withdrawal action automatically causes the data stored on the card by means of the opaque areas to be read, processed, and read into a data storage memory. The Card Reader 12 shown in FIG. 3, comprises the Light Array 13, and two Lenses 14*a* and 14*b* for focusing the light passing through the clear areas of Card 11 onto Photo Detectors 15*a* and 15*b*. The electrical signals created in the photo detectors are amplified and the resultant output is sent to the Detection Logic 10 shown in FIG. 2.

The light source in Array 13 positioned to be over the clear area at the bottom of each data column of Card 11 is always illuminated. This light source is called the clock light and the clear areas under it on Card 11 have called the clock areas. For illustrative purposes, the clock light is shown separate from the remainder of the Light Array 13 in FIG. 2.

The light sources in Light Array 13 (except for the clock light) are caused to be illuminated individually in a scan sequence which is controlled by Scan Counter 18.

The light received via the clock light positioned over a clock area is detected by Photo Cell 19, amplified and sent to a pulse edge detector consisting of a Bit Dealy 20, Invertor 21 and an AND Gate 22. The action of the edge detector is such that a signal will occur on line 23 only when the photo cell has just received light. Thus as each clock area is positioned over Photo Cell 19, a pulse will be generated on line 23 when such a position is first reached. If Card 11 is kept stationary, then the action of the edge detector is such that after first reaching a clock area, no further signals are created on line 23. These signals are called card clock signals.

Before Card 11 is inserted, no signal will appear on line 23 because of the action of the edge detector. When a card clock signal appears on line 23 it causes Scan Counter 18 to be reset. Scan Counter 18 is a counter modulo 41. Count zero corresponds to detection of light through the initializer area in the first column while counts 1 through 40 correspond to the 0 to 39 db encoded data.

Scan Counter 18 is incremented by clock pulses received from AND Gate 24. These pulses will occur if Latch 25 is in its "set" condition. Latch 25 is a flip-flop which is set by a signal appearing on line 23. The action is such that Scan Counter 18 is caused to be reset each time a clock area is "read" by Photo Cell 19 and an edge detection occurs indicating motion of Card 11. After being reset,, Scan Counter 18 is incremented by clock pulses from the system logic clock which are transferred via AND gate 24.

The binary count contained in Scan Counter 18 is sent to Decoder 17. Decoder 17 converts the binary count number to decimal numbers which are used to energize the corresponding light sources in Light Array 11. In this manner, the individual light sources are caused to be individually illuminated in a scan sequence starting from 0 and proceding to the light source number 40.

The light from the Light Array 13 for light sources 2 through 42 passes through the clear areas of Card 11 and is focused by Lens 14 on Photo Cell 16. Latch 25 will be reset by a signal from AND Gate 26. A signal will be generated by AND gate 26 if a light pulse is received by Photo Cell 16 and if Scan Counter 18 is not in its zero state. Decoder 17 decodes the states of Scan Counter 18 and the zero state is inverted by Invertor 28 to appear as an input to AND Gate 26.

The first function that must be accomplished by System 10 of FIG. 2 is to detect that Card 11 has been fully inserted. When this condition is detected, System 10 must then be prepared to read the db information in each column as Card 11 is withdrawn from the card reader. When Card 11 is inserted into the card reader, a sequence of card clock signals are generated on line 23. However, until the card reaches Stop 18, Flip-Flop 30 inhibits any data which may be read from being written into Data Memory 37.

Column Counter 29 is incremented by the signals appearing on line 23 and the contents of this counter thereby correspond to each data column on Card 11.

The second function accomplished by System 10 is to "read" the height of each opaque column centered over a clock area as Card 11 is withdrawn from the card reader. As described above, each time that a clock area appears under the clock light, Scan Counter 18 is reset and Latch 25 is set so that clock pulses can increment Scan Counter 18. Column Counter 29 is reset by a signal created by AND Gate 27. This signal will be created when the light from Light Source Zero is detected by Photo Cell 14 when Card 11 has been inserted fully to Stop 18. As Card 11 is withdrawn, Column Counter 29 is incremented each time a clock area appears under the clock light source.

During a column read, Scan Counter 18 causes each of the light sources to be illuminated in a scan sequence. When the first light not over an opaque area, and not over the initializer area, is illuminated, Photo Cell 16 detects the illumination and generates a signal that resets Latch 25 via AND Gate 26. The contents of Scan Counter 18 corresponds to the number of db read from Card 11. This count is transferred and stored in Data Memory 37. The address of the data to be stored is the column information contained in Column Counter 29.

Data can be written into Data Memory 37 only when a signal has been generated by AND Gate 33. Such a signal will be generated if Flip-Flop 30 is not set and if a light signal has been detected by Photo Cell 16 corresponding to any light source from 1 to 40. Flip-flop 30 is set by a signal from AND Gate 31. AND Gate 31 will create a signal when Photo Cell 16 detects illumination from any light source from 1 to 40 and Column Counter 29 has been incremented to Count 31. Thus the function of Flip-Flop 30 is to prevent spurious data from being read into Data Memory 37 when no card has been inserted into the card reader or during the insertion of a card. In this system state, Column Counter 29 will have been previously incremented to 31. Flip-Flop 30 is reset at the same time that Column Counter 29 is reset.

The contents of Scan Counter 18 at the end of each scan of Light Array 13 contains a count equal to the location of the first light source scanned which does not appear under an opaque area. The count is transferred via Adder 35 to the DB Convert ROM 34. The binary number $q$ appearing at the input to DB Convert ROM 34 is used to address a corresponding harmonic coefficient $c_q$ from the memory and cause the addressed number to be transferred to Data Memory 37.

Adder 35 is used to alter the data encoded on Card 11. It is convenient to encode the card so that each harmonic coefficient is relative to an arbitrary value of 0 db. However, in practice some tones are desired at various loudness levels. Adder 35 is essentially a volume control. For example, adding a negative increment to each number received from Scan Counter 18, the net result is that a constant number of db is subtracted from each db value read from Card 11 by System 10.

DB Convert ROM 34 converts the numbers transferred by Adder 35 to the binary number system for the harmonics $c_q$ used by the Polyphonic Tone Synthesizer in the Harmonic Coefficient Utilization Means 36. Table 1 lists the address of DB Convert ROM 34 and the binary numbers contained at each address. For illustration, the corresponding decimal numbers are shown.

TABLE 1

| | | | | | |
|---|---|---|---|---|---|
| 1 | 0000010 | 2 | 21 | 0001110 | 14 |
| 2 | 0000010 | 2 | 22 | 0010000 | 16 |
| 3 | 0000010 | 2 | 23 | 0010010 | 18 |
| 4 | 0000010 | 2 | 24 | 0010100 | 20 |
| 5 | 0000011 | 3 | 25 | 0010111 | 23 |
| 6 | 0000011 | 3 | 26 | 0011001 | 25 |
| 7 | 0000011 | 3 | 27 | 0011100 | 28 |
| 8 | 0000100 | 4 | 28 | 0100000 | 32 |
| 9 | 0000100 | 4 | 29 | 0100100 | 36 |
| 10 | 0000101 | 5 | 30 | 0101000 | 40 |
| 11 | 0000101 | 5 | 31 | 0101101 | 45 |
| 12 | 0000110 | 6 | 32 | 0110011 | 51 |
| 13 | 0000110 | 6 | 33 | 0111001 | 57 |
| 14 | 0000111 | 7 | 34 | 1000000 | 64 |
| 15 | 0001000 | 8 | 35 | 1000111 | 71 |
| 16 | 0001001 | 9 | 36 | 1010000 | 80 |
| 17 | 0001010 | 10 | 37 | 1011010 | 90 |
| 18 | 0001011 | 11 | 38 | 1100101 | 101 |
| 19 | 0001101 | 13 | 39 | 1110001 | 113 |
| 20 | 0001101 | 13 | 40 | 1111111 | 127 |

An alternative light array source is a trace on a cathode ray tube. The tube face is positioned over Card 11 as shown in FIG. 3 so that a single line trace lies in the position shown for the Light Array 13. The cathode ray beam is scanned in a well-known fashion from the contents of Scan Counter 18. The number residing in Scan Counter 18 is converted to an analog signal by means of a conventional digital-to-analog converter. The resulting analog signal is then used to position the cathode ray tube trace. The remainder of System 10 is the same as that previously described.

The card reader has been described above as a means for providing an alterable voice for a musical tone generator. The invention is not limited to this application.

In particular, the invention is advantageously used in conjunction with a tone generator of the type commonly called by the generic term "tone synthesizer." In a tone synthesizer a wide variety of time varying modulations are employed during the generation of a tone to create tonal effects. The variety of time varying modulations is created by a large number of controls which must be carefully set for each particular desired tonal effect. The subject invention readily provides a means for introducing a number of predetermined values for each of a set of tone synthesizer controls. The position of each control is encoded by the height of an opaque column centered over a clock area. Each column is read into a data memory assigned for control data. The db Convert ROM 34 is coded in a predetermined fashion to generate any desired transfer relationship between the height of an opaque column on Card 11 to the value to be assigned to an associated control.

The system clock incrementing Scan Counter 18 must operate at a speed sufficiently fast so that a complete column scan can occur before the card is pulled to an adjacent column. Let W represent the width of a data column on Card 11 and H represent the height of the column. The width of the 32 columns is 32W. If the operator extracts Card 11 in a time T, then each column must be scanned in a time T/32. Typically 32W is a length of 3 inches and the card is fully withdrawn in about one second. Each data column width is 3/32=0.09375 inches and must be scanned in 0.03125 seconds. Since 40 lights are to be scanned sequentially, the minimum scan frequency is 40/0.3125=1280 hz. Intending to claim all novel useful and unobvious features shown or described the applicant makes the following

I claim:

1. In a musical instrument of the type including a keyboard having a plurality of key-operated switches, a plurality of tone setting stop switches, generation means for synthesizing a musical waveshape by calculating its constituent generalized Fourier components and wherein each Fourier component is established by a harmonic coefficient associated with the corresponding Fourier component, said generation means including first circuitry operative during a computation cycle for individually calculating the constituent Fourier components of the musical waveshape, an accumulator for summing the constituent Fourier components to obtain each musical waveshape amplitude the relative amplitude of said constituent Fourier components being established by a set of harmonic coefficients utilized by said first circuitry, the improvement for altering said set of harmonic coefficients comprising;

data card encoded with said set of harmonic coefficients, card reader means for converting said encoded set of harmonic coefficients on said data card to electrical signals, conversion means for converting said electrical signals to a data format utilized by said first circuitry whereby said converted electrical signals represent elements of said set of harmonic coefficients, first memory means for writing said converted electrical signals to be thereafter read out, and utilization means comprising circuitry for selectively reading out said converted electrical signals from said first memory means and for providing converted electrical signals to said first circuitry.

2. In a musical instrument according to claim 1 wherein said data card further comprises;

optical liqht opaque areas imprinted on optical light transparent material whereby light opaque areas represent encoded data; said encoding comprising;

a number W of parallel opaque columns each of a length corresponding to an element of said set of harmonic coefficients, a light opaque clocking area located at right angles to said W opaque columns and containing a sequence of clock areas arranged in a line wherein each comprises a light transparent area centered with respect to each said opaque column, and an initializing area within the column corresponding to the minimum of said set of harmonic coefficients.

3. In a musical instrument according to claim 2 wherein said card reader means further comprises;

an enclosure comprising a slot to accomodate the insertion within of said data card and whereby when data card is inserted ambient light is inhibited from interior of said enclosure, a linear array of a number N of electrically operated light sources arranged in a column and located parallel with and adjacent to position of said opaque columns imprinted on said data card when inserted in said enclosure, a first and second photo cell for converting incident light into electrical signals, and a wall for providing a mechanical stop to limit the maximum insertion position of data card in said enclosure.

4. In a musical instrument according to claim 3 wherein said card reader means further comprises;

a first and second lens whereby light emitted from said linear array and transmitted through transparent areas of said data card is focused respectively on photo sensitive areas of said first and second photo cells.

5. In a musical instrument according to claim 3 wherein said conversion means further comprises;

initializer circuitry means responsive to electrical signals converted by said first and second photo cells for initializing said conversion means when said data card has been inserted into said enclosure in said maximum insertion position.

6. In a musical instrument according to claim 5 wherein said conversion means further comprises;

an edge detector responsive to electrical signal converted by said first photo detector whereby a clock pulse signal is generated when incident light on photo detector changes from no light to a light state, a clock for generating timing signals, first latch means responsive to said clock pulse signal whereby a counting signal is generated when clock pulse signal is received and whereby counting signal is not generated when a detection signal is received, clock gating means responsive to said counting signal and said timing signals whereby timing signals are transmitted when counting signal is generated, a scan counter incremented by timing signals transmitted by said clock gating means and reset to its initial state in response to said clock pulse signal, the contents of the scan counter correspond to the length of selected opaque columns imprinted on said data card, decoder circuitry means for converting contents of said scan counter to electrical signals which cause selected elements of said linear array of light sources to be illuminated in a sequence corresponding to the contents of the scan counter, an initializer light source which is a member of said linear array of light sources and located in a position adjacent to said initializing area when said data card is inserted in said maximum insertion position, and first detection logic circuitry for generating said detection signal in response to electrical signals converted by said second photo cell and which does not generate detection signal when said electrical signal corresponds to said initializer light.

7. In a musical instrument according to claim 6 wherein said first memory means comprises;

a column counter incremented by said clock pulse signal and reset to its initial state in response to initialize signal wherein contents of column counter correspond to elements of said opaque columns imprinted on said data card, second detection logic circuitry responsive to said decoder circuitry means wherein said initialize signal is created when light from said initializer light source is converted by said second photo cell, second latch means set when said column counter is incremented to its maximum count and said detection signal is generated and is reset by said initialize signal wherein an inhibit signal is generated when second latch means is set, and first memory means further comprising circuitry for writing said converted electrical signals in a memory location corresponding to contents of said column counter when said detection signal is received and said inhibit signal is not generated.

8. In a musical instrument according to claim 7 wherein said conversion means comprises;

a first conversion memory containing a set of said harmonic coefficient values each element associated with a corresponding count of said scan counter, and addressing means responsive to contents of said scan counter for reading out said harmonic coefficient values from said first conversion memory thereby producing said converted electrical signals corresponding to length of opaque columns imprinted on said data card.

9. In a musical instrument according to claim 8 wherein said addressing means further comprises;

loudness circuitry means whereby a loudness signal is generated, and an adder for algebraically summing contents of said scan counter with said loudness signal thereby causing corresponding changes in said read out harmonic coefficient values from said first conversion memory.

10. In a musical instrument according to claim 2 wherein said card reader means further comprises;

an enclosure comprising a slot to accomodate the insertion within of said data card and whereby when data card is inserted ambient light is inhibited from interior of said enclosure, a cathode ray tube having its face located adjacent to inserted data card and a line scan deflection coinciding with the direction of said opaque columns when data card is inserted, a first and second photo cell for converting incident light into electrical signals, and a wall for providing a mechanical stop to limit the maximum insertion position of data card in said enclosure.

11. In a musical instrument according to claim 7 wherein said conversion means comprises;

a second conversion memory containing a set of tone control values each element associated with a corresponding count of said scan counter, second addressing means responsive to contents of said scan counter for reading out said tone control values from said second conversion memory, and tone control utilization circuitry means responsive to said read out tone control values whereby data encoded on said data card is utilized by control circuitry in said musical instrument.

* * * * *